US009500003B1

(12) United States Patent
Haber

(10) Patent No.: US 9,500,003 B1
(45) Date of Patent: Nov. 22, 2016

(54) PROTECTOR FOR SIDE MOUNTED VEHICLE DOOR LOCK

(71) Applicant: Greg Haber, Woodbury, NY (US)

(72) Inventor: Greg Haber, Woodbury, NY (US)

( * ) Notice: Subject to any disclaimer, the term of this patent is extended or adjusted under 35 U.S.C. 154(b) by 0 days.

(21) Appl. No.: 15/013,055

(22) Filed: Feb. 2, 2016

Related U.S. Application Data

(60) Provisional application No. 62/199,297, filed on Jul. 31, 2015.

(51) Int. Cl.

| | |
|---|---|
| ***E05B 13/08*** | (2006.01) |
| ***E05B 17/20*** | (2006.01) |
| ***E05B 65/06*** | (2006.01) |
| ***E05B 83/10*** | (2014.01) |
| ***E05B 13/00*** | (2006.01) |

(52) U.S. Cl.
CPC ..... *E05B 17/2084* (2013.01); *E05B 13/002* (2013.01); *E05B 65/06* (2013.01); *E05B 83/10* (2013.01); *E05B 2017/2096* (2013.01); *Y10S 292/32* (2013.01); *Y10T 70/498* (2015.04); *Y10T 70/5735* (2015.04); *Y10T 70/5739* (2015.04); *Y10T 70/5774* (2015.04); *Y10T 70/5779* (2015.04)

(58) Field of Classification Search
CPC .. E05B 17/2084; E05B 13/002; E05B 83/10; E05B 65/06; E05B 2017/2096; Y10T 70/493; Y10T 70/496; Y10T 70/498; Y10T 70/573; Y10T 70/5735; Y10T 70/5739; Y10T 70/5774; Y10T 70/5779; Y10S 292/32
USPC ..... 70/54–56, 201–203, 211, 212, DIG. 58, 70/DIG. 43, DIG. 56, 417; 292/307 B, 292/DIG. 32, 240, 307 R, 104, 205, 218, 292/327–329, 288, 289, 291, 294; 411/910
See application file for complete search history.

(56) References Cited

U.S. PATENT DOCUMENTS

| | | | | |
|---|---|---|---|---|
| 4,877,276 | A * | 10/1989 | Pastva | E05B 83/10 292/11 |
| 5,553,904 | A * | 9/1996 | Lorenzo | B65D 90/008 292/307 B |
| 5,775,747 | A * | 7/1998 | Navarsky | E05B 13/002 292/307 B |
| 5,791,702 | A * | 8/1998 | Liroff | E05B 83/10 292/307 R |
| 6,553,798 | B1 * | 4/2003 | Larsen | E05B 13/002 292/240 |

(Continued)

*Primary Examiner* — Lloyd Gall
(74) *Attorney, Agent, or Firm* — Epstein Drangel LLP; Robert L. Epstein

(57) ABSTRACT

The lock assembly includes a handle and a rod mounted for movement relative to the vehicle door which is movable between a first position wherein the door cannot be opened and a second position wherein the door can be opened. A mechanical linkage, including a bracket and pivot pin, connects the handle and the rod such that the rod moves between the first position and the second position as the handle is moved between a locked position and an unlocked position. The protector includes a rigid member adapted to cover the mechanical linkage and a collar for mounting the cover member on the handle. The cover member extends from the collar wall and includes a section adapted to align with the mechanical linkage which extends in a plane substantially parallel to but offset from the plane of the collar wall to accommodate the increased width of the mechanical linkage.

10 Claims, 7 Drawing Sheets

(56) References Cited

U.S. PATENT DOCUMENTS

| | | | | |
|---|---|---|---|---|
| 7,162,898 | B2 * | 1/2007 | Gogel | E05B 13/001 292/258 |
| 7,441,425 | B2 * | 10/2008 | Jeong | B65D 90/008 292/104 |
| 8,011,213 | B1 * | 9/2011 | Gogel | E05B 13/001 292/218 |
| 8,627,693 | B1 * | 1/2014 | Haber | E05B 65/06 292/212 |
| 2009/0260185 | A1 * | 10/2009 | Conner | E05B 83/10 16/251 |
| 2010/0170310 | A1 * | 7/2010 | Ivashin | E05B 39/025 70/91 |
| 2012/0001757 | A1 * | 1/2012 | Jung | E05B 13/002 340/542 |
| 2012/0103032 | A1 * | 5/2012 | Thomsen | E05B 13/002 70/14 |
| 2012/0210754 | A1 * | 8/2012 | Thomsen | E05B 13/002 70/14 |
| 2012/0293655 | A1 * | 11/2012 | Loughlin | H04N 7/183 348/143 |
| 2015/0287297 | A1 * | 10/2015 | Harrison | E05B 83/10 340/545.1 |

* cited by examiner

PROTECTOR FOR SIDE MOUNTED VEHICLE DOOR LOCK

CROSS-REFERENCE TO RELATED APPLICATIONS

Priority is claimed on Provisional Patent Application No. 62/199,297, filed Jul. 31, 2015, the contents of which are incorporated herein by reference.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to lock assemblies for side mounted doors for vehicle cargo compartments and more particularly to a lock assembly for a side mounted door of a vehicle cargo compartment of the type having a pivotal handle connected to a moveable rod by a mechanical linkage which includes a protector positioned to prevent access to the linkage to protect the assembly from attack and to the structure of the protector.

2. Description of Prior Art Including Information Disclosed Under 37 CFR 1.97 and 1.98

Vehicles, aircraft, truck trailers, ships, and the like, are used to transport valuable cargo within their containers from one destination to another. These transports secure the cargo within their containers, and the cargo is only accessible via a side mounted locking swing-out door. A variety of different locks for existing swing-out doors have been fashioned, but burglars have found simple ways to rob and tamper with these locks in order to steal valuable cargo.

One such lock is disclosed in U.S. Pat. No. 8,627,693 issued Jan. 14, 2014. That patent teaches an assembly for a vehicle cargo compartment having an opening defined by a door jamb, a cargo door adapted to close the opening, a rod linearly moveable to engage the door jamb and a handle or latch mountable to the rod. The assembly includes a housing having an inclined opening. The housing is mounted to the cargo door parallel the rod. A handle receiving part within the housing has an inclined opening adapted to align with the inclined opening of the housing for accepting the handle therein. The handle receiving part is responsive to movement of the handle within the housing between a locked and an unlocked position and engages the locking means when the handle receiving part is in the locked position.

In the above lock assembly, one end of the handle is connected to the rod by a mechanical linkage. The mechanical linkage includes a bracket and a pivot pin which permits the handle to pivot relative to the rod as the rod is moved linearly into and out of the opening in the door jamb to lock and unlock the door.

However, the mechanical linkage between the handle and rod is exposed when the handle is in the locked position. Thus, the lock assembly can be defeated by breaking and removing the pivot pin, allowing the rod to be disconnected from the handle and moved to its unlocked position such that the door can be opened and the cargo compartment accessed.

It is, therefore, a primary object of the present invention to provide side mounted vehicle door lock with a protector for the mechanical linkage connecting the handle and rod.

It is another object of the present invention to provide a protector for a side mounted vehicle door lock which includes a collar which surrounds the handle.

It is another object of the present invention to provide a protector for a side mounted vehicle door lock which includes a cover part adapted to align with the mechanical linkage when the handle is received in the lock housing.

It is another object of the present invention to provide a protector of a side mounted vehicle door lock in which the cover member extends from the collar such that it prevents access to the mechanical linkage when the collar is received on the handle.

It is another object of the present invention to provide a protector of a side mounted vehicle door lock in which the cover member extends from a wall of the collar.

It is another object of the present invention to provide a protector of a side mounted vehicle door lock in which the cover member includes a section which extends in a plane substantially parallel to the plane of the collar wall from which it extends but is offset from of that plane to accommodate the additional thickness of the mechanical linkage.

It is another object of the present invention to provide a protector of a side mounted vehicle door lock in which a section of the cover member is curved.

It is another object of the present invention to provide a protector of a side mounted vehicle door lock in which the cover member and the collar are integral.

It is another object of the present invention to provide a protector of a side mounted vehicle door lock in which the cover member and the collar are formed of metal.

It is another object of the present invention to provide a protector of a side mounted vehicle door lock in which the cover member and the collar are formed of high-strength steel.

BRIEF SUMMARY OF THE INVENTION

The above objects are achieved by the present invention one aspect of which relates to a lock assembly for a side mounted door of a cargo compartment of a vehicle. The lock assembly includes a handle and a rod mounted for movement relative to the door. The rod is movable between a first position, wherein the door cannot be opened, and a second position, wherein the door can be opened. A mechanical linkage connects the handle and the rod such that the rod is moved between the first position and the second position as the handle moves between a locked position and an unlocked position. Means are provided for retaining the handle in the locked position. Means are also provided for protecting the mechanical linkage when the handle is in the locked position.

The mechanical linkage includes a bracket and a pivot pin. The bracket has a wall with an opening adapted to align with an opening in the handle. The pin is received through the opening in the bracket and the opening in the handle such that the end of the handle can pivot relative to the bracket. Preferably, the bracket is bifurcated.

The protecting means includes a member adapted to cover the mechanical linkage and means for mounting the cover member on the handle.

The cover member mounting means includes a collar. The cover member extends from the collar, more particularly, from a wall of the collar.

The cover member includes a portion which extends in a plane substantially parallel to but offset from the plane of the collar wall from which the cover member extends.

The cover member includes a section which is curved. The curved section is situated between the offset section and the collar.

The lock assembly further includes means for attaching the collar on the handle in a fixed position proximate the mechanical linkage.

In accordance with another aspect of the present invention, a protector for a lock assembly for a side mounted door of a cargo compartment of a vehicle is provided. The lock assembly includes a handle and a rod mounted for movement relative to the door for locking and unlocking the door. A mechanical linkage pivotally connects the handle and the rod. The protector includes a collar portion adapted to be received on handle proximate the mechanical linkage and a cover portion extending from the collar portion to a position over and aligned with the mechanical linkage such that the mechanical linkage cannot be accessed when the protector is present.

The mechanical linkage includes a bracket and a pivot pin. The bracket has a wall with an opening adapted to align with an opening in the handle. The pin is received through the opening in the bracket and the opening in the handle such that the end of the handle can pivot relative to the bracket. Preferably, the bracket is bifurcated.

The cover portion includes a first section extending from the collar portion and a second section extending from the first section. The collar portion has a wall situated in a plane. The first section of the cover portion extends from the collar wall. The second section is situated in a plane which is substantially parallel to and offset from the plane of the collar wall.

The first section is curved. The second section is substantially planar.

The collar is hollow. It is adapted to substantially surround the handle and is movable along the length of the handle to a position proximate the mechanical linkage.

The mechanical linkage includes a pivotal connection between the rod and the handle.

The pivotal connection includes a bracket attached to the rod and a pivot pin inserted through an opening in the bracket and an opening in the handle.

BRIEF DESCRIPTION OF THE SEVERAL VIEWS OF THE DRAWINGS

To these and to such other objects that may hereinafter appear, the present invention relates to a lock assembly for a side mounted vehicle door lock having a protector and to the structure of the protector, as described in detail in the following specification and recited in the annexed claims, taken together with the accompanying drawings, in which like numerals refer to like parts in which:

DETAILED DESCRIPTION OF THE INVENTION

Figure 1:
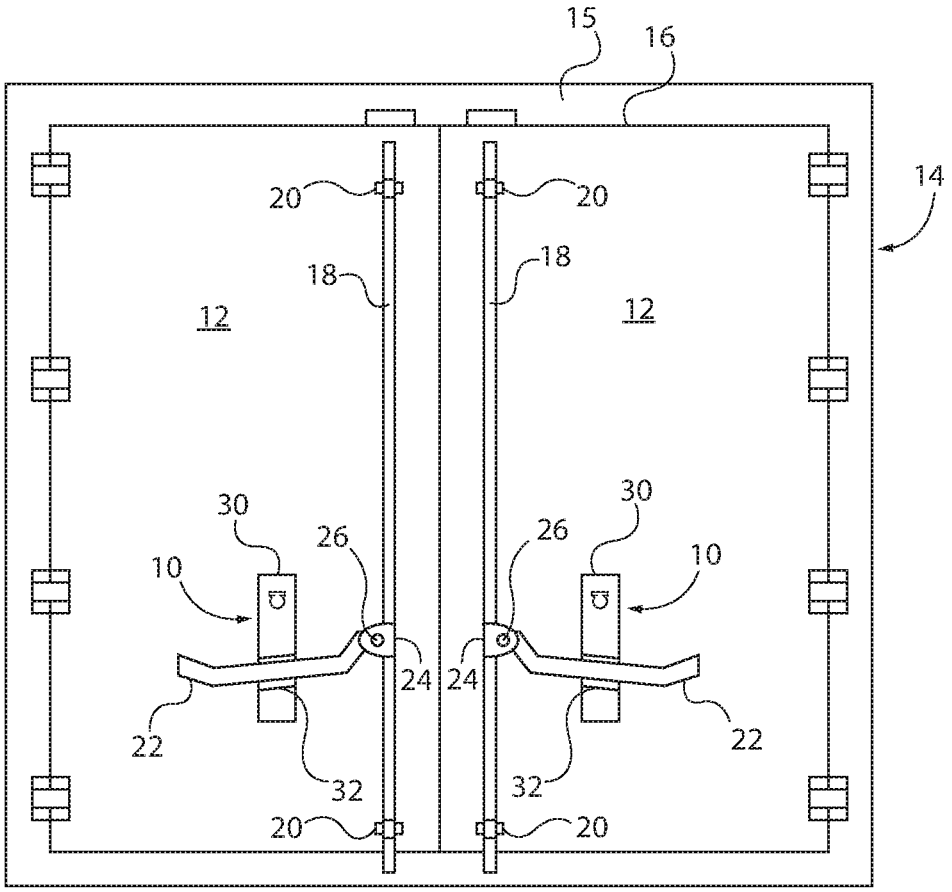
FIG. 1 is an elevation view of two "swing-out" type side mounted doors of the cargo compartment of a vehicle such as a truck trailer showing the doors in the closed position, with the side door lock housings and the handles in the unlocked position.

The present invention is directed to a protector for the mechanical linkage of a side lock assembly designed for use on a swing-out cargo door of the type disclosed in U.S. Pat. No. 8,627,693. The side lock assembly is illustrated in FIG. 1 which shows two lock assemblies 10, each installed on one of a pair of side-mounted cargo doors 12 in the access opening of a cargo container 14. The cargo container 14 may be transported or integrated within any type of vehicle, such as an automobile, truck, aircraft, or ship. The container access opening 16 is defined by a door jamb 15.

Each lock assembly cooperates with a rod 16 attached a door 12 to which the rod is mounted. The rod is attached to the door by brackets 20 such that the rod can be moved vertically between an upper, locked position in which the end of the rod engages an opening in door jamb 15 to retain the door 12 in the closed position to prevent access to compartment 14 and a lower, unlocked position, as shown in FIG. 1, where the end of the rod is remote from the door jamb opening and the door can be opened to access the cargo compartment.

A steel handle or latch 22 is attached to rod 18. Handle 22 can be used to move the door between open and closed positions and to move the rod vertically to lock and unlock the cargo door 12. In particular, the rod 18 is moved up and down relative to the door by handle 22 such that the end of the rod engages or disengages the door jamb 15. One end of handle 22 is attached to rod 18 by a bifurcated bracket 24 welded to the rod. Bracket 24 carries a pin 26 about which the end of handle 22 can pivot such that the rod can moved vertically.

Figure 2:
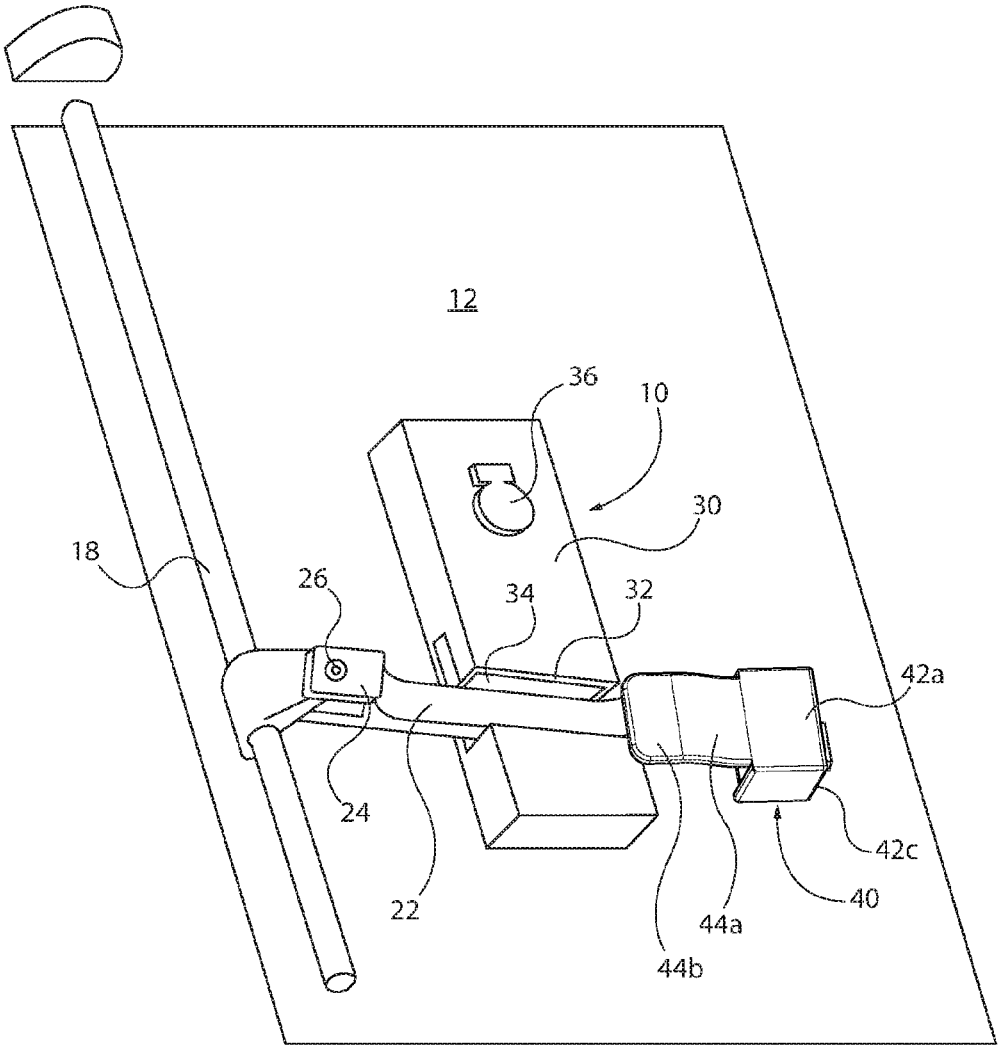
FIG. 2 is a perspective view of one side lock assembly for a side mounted door according to the preferred embodiment of the present invention with the handle in the unlocked position and the protector situated on the unattached end of the handle.

As best seen in FIG. 2, each lock assembly 10 includes a substantially hollow rectangular housing 30 permanently affixed to the surface of the cargo compartment door. The front wall of housing 30 has an inclined opening 32 adapted to receive the middle portion of handle 22.

Located within housing 30 is a vertically moveable handle receiving part 34. Part 34 is generally rectangular and has an inclined recess into which the handle can be received when part 34 is in its lower, unlocked position with the recess in part 34 aligned with opening 32 in housing 30, as seen in FIG. 2.

Rod 18 is attached to the surface of door 12 by brackets 20 such that it can move vertically to engage and disengage the door jamb. However, rod 18 can also rotate relative to the door about its axis as handle 22 is moved in an arc toward and away from housing 30. By pivoting about the axis of rod 18 handle 22 can be moved into and out of opening 32 in housing 30, as long as part 34 is in its lower, unlocked position, as seen FIG. 2.

Figure 3:
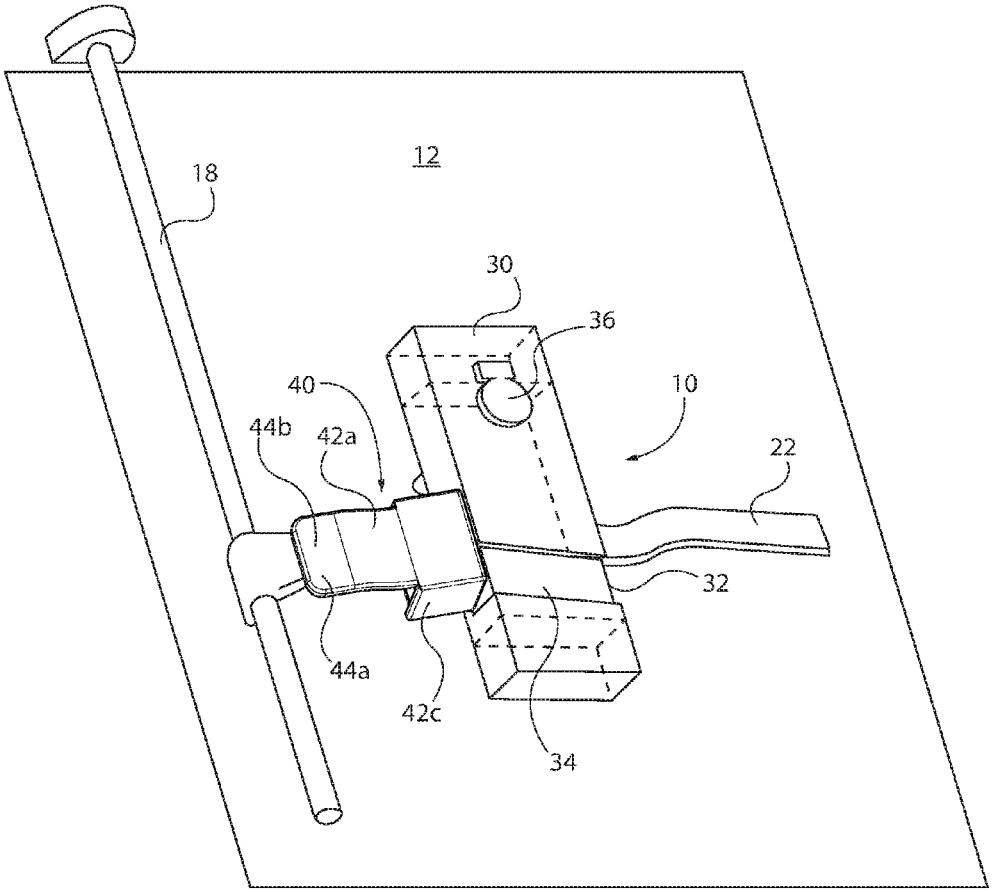
FIG. 3 is a perspective view of the side lock assembly on a side mounted door according to the preferred embodiment of the present invention with the handle in the locked position and the protector aligned with the mechanical linkage connecting the handle and the rod.

FIG. 3 shows the assembly after handle 22 has been received in the recess in part 34 and the handle has been manually moved upwardly relative to housing 30 to cause part 34 to move into the upper portion of housing 30. In that position, part 34 clears a spring-loaded protrusion (not shown) associated with a lock cylinder (not shown) within the housing. The protrusion is urged by the spring to a position intersecting the path of travel of part 34. When the protrusion is cleared by part 34, the protrusion is moved to a position wherein part 34 is prevented from moving back down housing 30.

The lock cylinder associated with the blocking protrusion is situated below a lock cylinder cover 36 on the upper portion of the wall of housing 30. Once part 34 is located in the upper, locked position within housing 30, part 34 cannot be moved from its locked position within housing 30 until cover 36 is moved out of the way and a key is inserted into the lock cylinder. Rotation of the key causes the blocking protrusion to move to a position remote from the path of travel of part 34 such that downward movement of part 34 is no longer prevented. That permits the handle to move part 34 to a position within the housing where the handle is again aligned with opening 32 in the housing and the rod no longer engages the door jamb. The handle can then be pivoted away from housing 30 to open the cargo door and permit access to the cargo compartment.

Referring again to FIG. 2, it can be seen that regardless of the position of handle 22, the linkage between the end of handle 22 and rod 18, which consists of bracket 24 and pin 26, is exposed and vulnerable to attack from external assault, such as by a hammer or the like. The purpose of the protector of the present invention is to prevent access to the linkage connecting the handle and rod when the handle is in the locked position such that the linkage is no longer vulnerable to attack when the handle is in the locked position. The result is that the security provided by the lock assembly is substantially increased.

That is accomplished by a protector 40 illustrated in FIGS. 5 through 10. Protector 40 is formed of high-strength steel and consists of a hollow collar portion 42 and a rigid cover portion 44. Cover portion 44 is preferably formed integrally with collar portion 42. It extends outwardly from the edge of collar portion 42 in a direction generally parallel to the axis of the collar portion, as seen in FIGS. 5, 6, 7 and 10.

Collar portion 42 consists of walls 42*a*, 42*b*, 42*c* and 42*d* which define the generally square, hollow interior of the collar portion 42. Collar portion 42 is received over the free end of handle 22 and moved along the handle to a position proximate the mechanical linkage connecting the rod and the other end of the handle.

Figure 5:
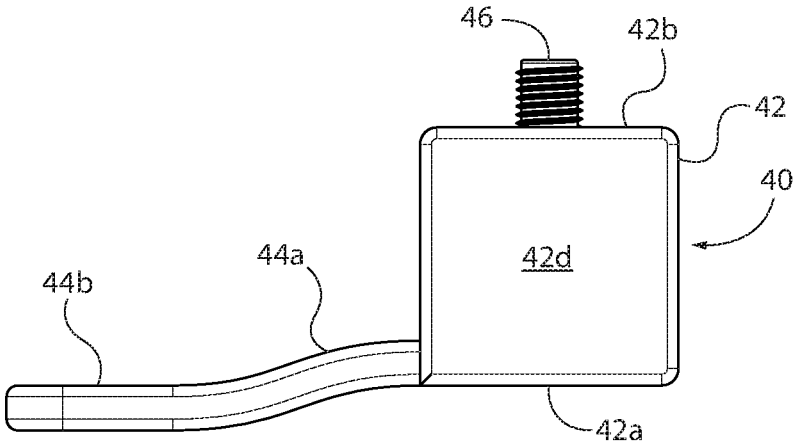
FIG. 5 is a top plan view of the protector.
Figure 6:
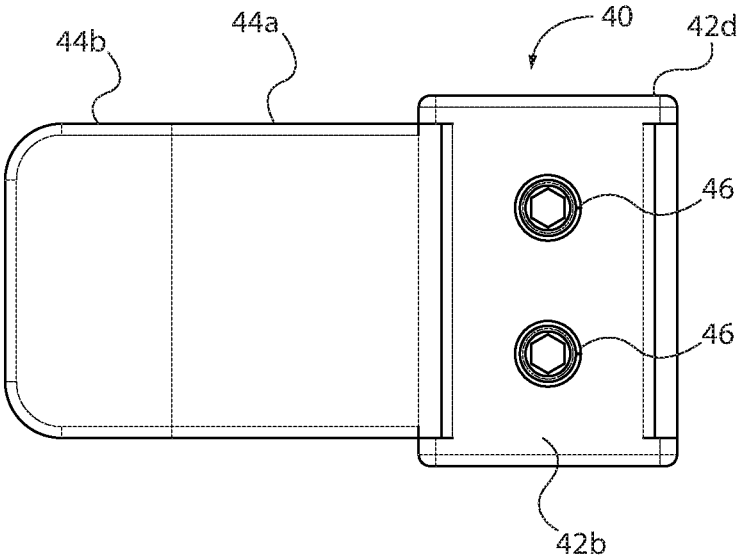
FIG. 6 is an elevation view of the protector showing the side of the protector which faces the vehicle door.
Figure 7:
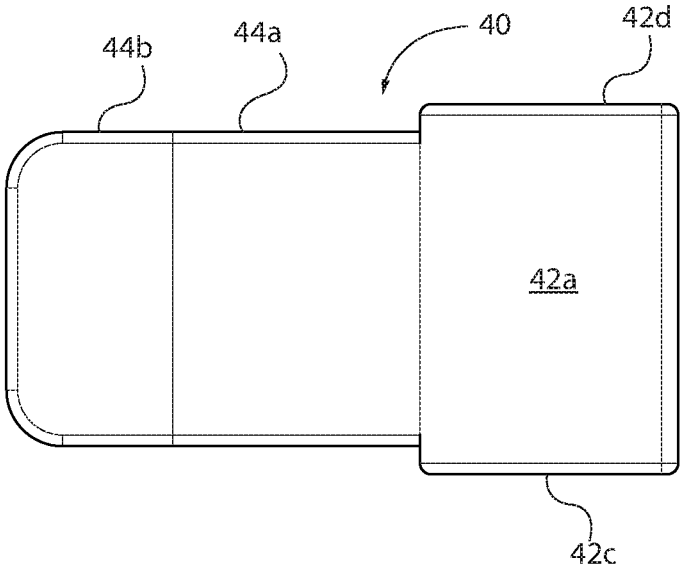
FIG. 7 is an elevation view of the protector showing the side of the protector which faces away from the vehicle door.
Figure 8:
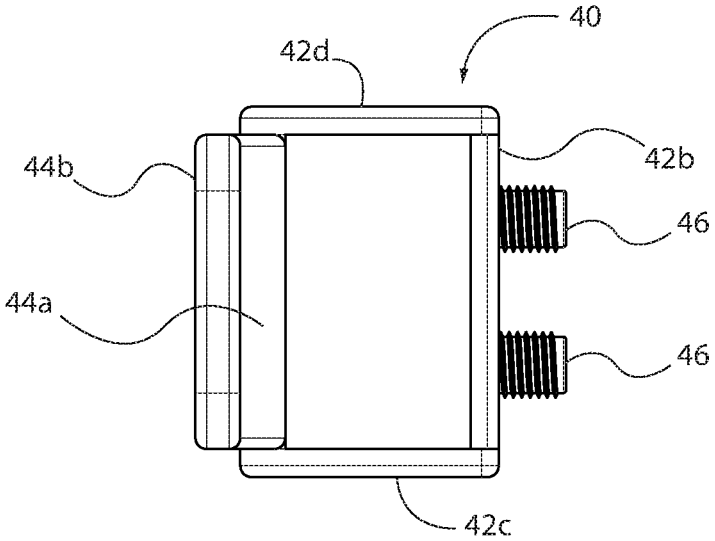
FIG. 8 is a front elevation view of the protector.
Figure 9:
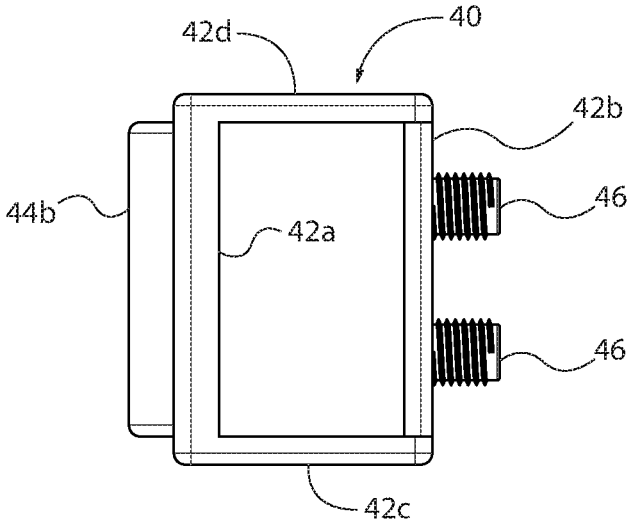
FIG. 9 is rear elevation view of the protector.
Figure 10:
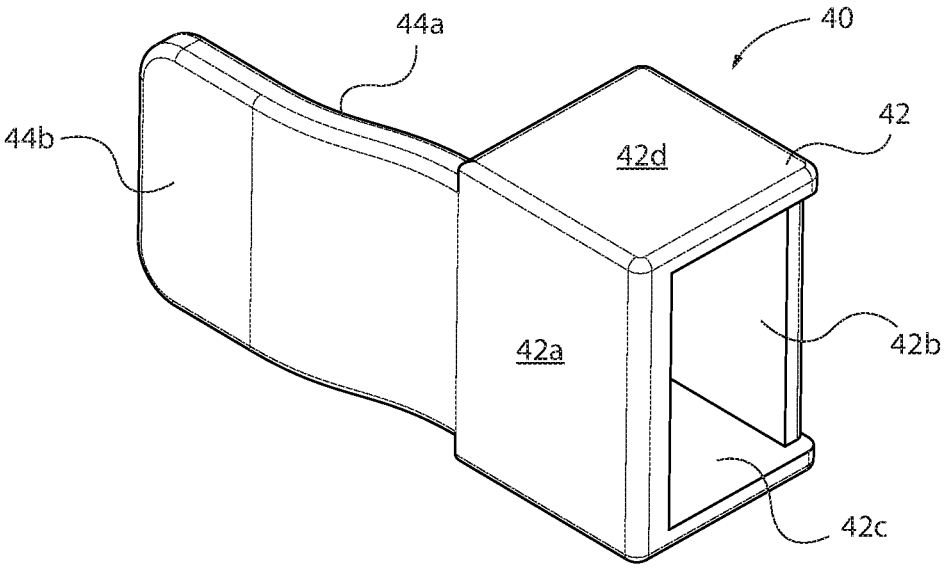
FIG. 10 is a perspective view of the protector.

Cover portion 44 extends from wall 42*a* of collar portion 42 and includes two sections, 44*a* and 44*b*. Section 44*a* is situated between collar portion 42 and section 44*b*. Section 44*a* is curved outwardly from the plane of wall 42*a*. Section 44*b* is generally planar. As best seen in FIG. 5, section 44*b* lies in a plane which is generally parallel to the plane of wall 42*a* of collar portion 42, from which section 44*a* extends, but is situated in a plane that is offset from the plane of wall 42*a*.

Figure 4:
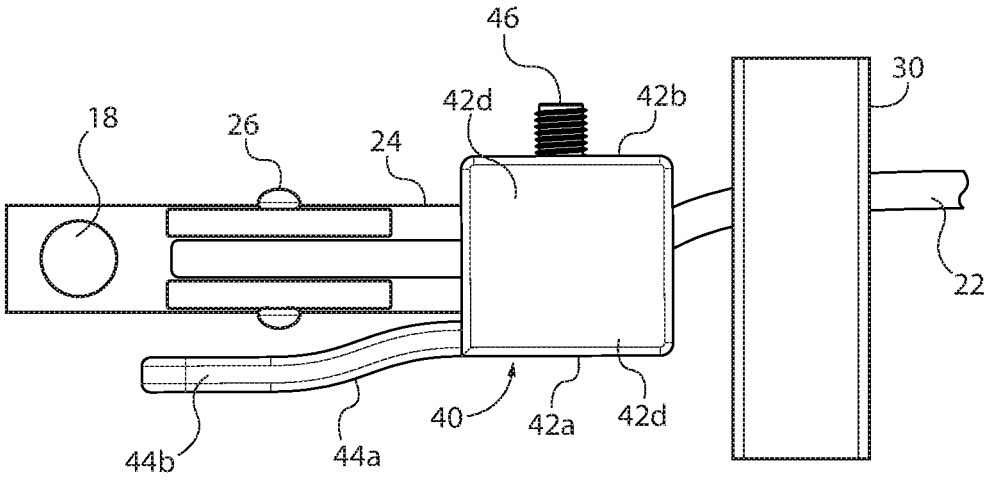
FIG. 4 is a top plan view showing the protector of FIG. 3 located on the handle proximate the mechanical linkage with the cover member aligned with the bracket and pivot pin.

The purpose of curving section 44*a* of cover portion 44 to position section 44*b* in a plane offset from the plane of wall 42*a* is to provide clearance for the bracket and pivot pin so that the protector can be properly situated on the handle at a location proximate the mechanical linkage. FIG. 4 is a view of the lock assembly from the top. From this figure it can be seen that bracket 24 and pin 26 are substantially wider than the width of the handle. If the plane of section 44*b* of cover portion 44 of the protector was not offset from the plane of wall 42*a* of the collar portion, it would not be possible to locate the protector in a position along the handle where the cover portion of the protector completely covers the pivot pin and the portion of bracket 24 where the pivot pin is located.

A pair of set screws 46 extend outwardly from wall 42*b* of the collar portion of the protector. The set screws are used to anchor the protector in position on handle 22 such that cover portion section 44*b* aligns with bracket 24 and pin 26. However, since set screws 46 extend from the wall 42*b* of collar portion 42 toward the surface of door 12, the screws cannot be accessed when the handle is in the locked position.

Referring now to FIGS. 2 and 3, in order to install protector 40 on the lock assembly, the protector is received over the free end of handle 22 as seen in FIG. 2. Handle 22 is pivoted about the axis of rod 18 such that it is remote from housing 30. Protector 40 is then moved along the handle until it is in a position proximate the linkage between the handle and the rod with section 44*b* of the cover portion 44 aligned with bracket 24 and particularly pin 26. The set screws 46 are tightened such that the protector can no longer move relative to the handle.

With the protector in place and the set screws tightened, the handle can be pivoted back to a position parallel to the cargo compartment door where the mid-section of the handle is situated within the recess of part 34 in housing 30. The handle is then moved upwardly to move part 34 within housing 30 to its upper, locked position such that the spring-loaded protrusion associated with the lock cylinder automatically moves to a position blocking part 34 from moving downward to release the handle until the key is inserted into the lock cylinder and rotated causing the protrusion to move out of the path of travel of part 34.

Moving the handle upward also moves rod 18 to a position where the rod end engages the door jamb. Rod 18 will remain in the locked position until part 34 is moved back to the lower portion of housing 30.

It will now be appreciated that the present invention relates to a lock assembly for a side mounted door of a cargo compartment of a vehicle including a handle and a rod mounted for movement relative to the door which is movable between a first position wherein the door cannot be opened and a second position wherein the door can be opened. A mechanical linkage connects the handle and the rod such that the rod moves between the first position and the second position as the handle is moved between a locked position and an unlocked position. Means for retaining the handle in the locked position are provided as are means for protecting the mechanical linkage when the handle is in the locked position.

The protecting means includes a rigid member adapted to cover the mechanical linkage and a collar for mounting the cover member on the handle. The cover member extends from the collar wall and includes a section adapted to align with the mechanical linkage which extends in a plane substantially parallel to but offset from the plane of the collar wall to accommodate the increased width of the mechanical linkage.

The mechanical linkage includes a bracket attached to the rod and a pivot pin inserted through an opening in the bracket and an opening in the handle to form a pivotal connection.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

I claim:

1. A lock assembly for use with a side mounted door of a cargo compartment of a vehicle having a handle, a rod mounted for movement relative to the door and being movable between a first position wherein the door cannot be opened and a second position wherein the door can be opened, and a mechanical linkage, including a bracket and a pivot pin, connecting the handle and the rod such that the rod moves between its first position and its second position as the handle moves between a locked position and an unlocked position, said assembly comprising means for retaining the handle in its locked position, and means for protecting the mechanical linkage when the handle is in said locked position, said means for protecting comprising a collar adapted to be mounted on the handle including a part in a plane and a cover member extending from said collar part having an outer major face with a section which curves outwardly along its length as it extends from said collar part plane and having a section situated in a plane substantially parallel to and offset from said collar part plane, to be in alignment with the pivot pin.

2. The lock assembly of claim 1 wherein said curved section is situated between said offset section and said collar part.

3. The lock assembly of claim 1 further comprising means for attaching said collar on the handle in a fixed position.

4. The lock assembly of claim 3 wherein said means for attaching comprises at least one screw.

5. The lock assembly of claim 4 wherein said collar comprises a part situated behind the handle and wherein said at least one screw is situated in said collar part behind the handle and is not accessible when the handle is in said locked position.

6. A protector for a lock assembly for use with a side mounted door of a cargo compartment of a vehicle having a handle, a rod mounted for movement relative to the door for locking and unlocking the door, and a mechanical linkage, including a bracket and a pivot pin, pivotally connecting the handle and the rod, wherein said protector comprising a collar portion adapted to be received over the handle proximate the mechanical linkage and a cover member extending from said collar to a position over and aligned with the mechanical linkage such that the mechanical linkage cannot be accessed, said collar comprising a part in a plane and a cover member extending from said collar part having an outer major face with a section which curves outwardly along its length as it extends from said collar part plane and having a section situated in a plane substantially parallel to and offset from said collar part plane, to be in alignment with the pivot pin.

7. The protector of claim 6 wherein said curved section is situated between said offset section and said collar part.

8. The protector of claim 6 further comprising means for attaching said collar on the handle in a fixed position.

9. The protector of claim 8 wherein said means for attaching comprises at least one screw.

10. The protector of claim 9 wherein said collar comprises a part situated behind the handle and wherein said at least one screw is situated in said collar part behind the handle and is not accessible when the handle is in said locked position.

* * * * *